US005435735A

United States Patent [19]

Wittig et al.

[11] Patent Number: 5,435,735

[45] Date of Patent: Jul. 25, 1995

[54] CATALYTIC CONVERTER SENSOR CONNECTOR

[75] Inventors: Lutz Wittig, Langen; Jürgen Ryll, Egelsbach; Harald M. Lutsch, Dietzenbach, all of Germany

[73] Assignee: The Whitaker Corporation, Wilmington, Del.

[21] Appl. No.: 194,597

[22] Filed: Feb. 10, 1994

[30] Foreign Application Priority Data

| | | | |
|---|---|---|---|
| Feb. 22, 1993 | [GB] | United Kingdom | 9303501 |
| Jul. 6, 1993 | [GB] | United Kingdom | 9313967 |
| Aug. 9, 1993 | [GB] | United Kingdom | 9316495 |

[51] Int. Cl.[6] ..... H01R 25/00

[52] U.S. Cl. ..... 439/79; 439/637

[58] Field of Search ..... 439/492, 59, 494, 493, 439/637

[56] References Cited

U.S. PATENT DOCUMENTS

| | | | |
|---|---|---|---|
| 3,425,021 | 1/1969 | Fow et al. | 439/493 X |
| 3,851,294 | 11/1974 | Palazzetti et al. | 439/493 X |
| 4,373,764 | 2/1983 | Ulrich . | |
| 4,621,882 | 11/1986 | Krumme | 439/492 X |
| 4,850,882 | 7/1989 | Yu | 439/59 X |
| 4,934,947 | 6/1990 | Brummans et al. | 439/492 X |
| 5,108,315 | 4/1992 | Vogl et al. | 439/639 X |

FOREIGN PATENT DOCUMENTS

| | | | |
|---|---|---|---|
| 0353421 | 2/1990 | European Pat. Off. . | |
| 2261680 | 9/1975 | France . | |
| 2805598 | 8/1979 | Germany . | |
| 3210804 | 10/1983 | Germany | 439/494 |
| 01187444 | 7/1989 | Japan . | |

*Primary Examiner*—David L. Pirlot
*Assistant Examiner*—Daniel Wittels
*Attorney, Agent, or Firm*—Adrian J. LaRue; Mary K. Van Ahen

[57] ABSTRACT

A circular sensor connector has terminals to make contact between an internal printed circuit board and conducting wires. In order to obtain a cost effective and compact configuration, the plurality of identical terminals are disposed in a radial manner around the printed circuit board whereby contact arms having an arcuate contact profile, project towards the printed circuit board and make contact therewith.

21 Claims, 11 Drawing Sheets

CATALYTIC CONVERTER SENSOR CONNECTOR

BACKGROUND OF THE INVENTION

1. Field of the Invention

This invention relates to a circular catalytic converter sensor connector for connection between an internal printed circuit board and terminals in a compact configuration.

2. Description of the Prior Art

Catalytic converter sensors, commonly called lambda probes, are usually attached to the housing of a catalyzer and project a sensor through a hole in the housing to measure various parameters of the exhaust gases. This hole in the catalyzer structure not only affects the mechanical integrity thereof but also produces a risk of gas leakage through the sensor hole. For correct functioning of the catalyzer, this gas leakage should be avoided. The size of the probe hole must therefore be kept to a minimum, as a small hole is easier to seal and has little effect on the mechanical integrity of the catalyzer housing.

Although reference above is made to measurement of exhaust gases in a catalyzer, the above remarks are often true in many other technical domains, that is to say, where one is measuring parameters of a liquid or gas within a container.

The probe usually comprises a printed circuit board which is partially exposed in the exhaust gas part of the catalyzer and partially within a connector attached to the catalyzer housing, whereby terminals in the connector make electrical contact between the circuit traces on the printed circuit board to external conducting wires. The printed circuit board serves to electronically process the measurement signals of the probe, and due to the high temperatures, the board is made from a material such as ceramic that can withstand high temperature. The boards are made by pre-cutting out of a large ceramic board the individual boards with a laser, the boards then broken off along the laser trace lines. One of the problems associated to this procedure is that the ceramic boards have sharp edges that would damage electrical contacts of a connector when inserted between the contacts.

In the prior art the plurality of terminals, for example eight terminals, are disposed in two rows, one on either side of the printed circuit board. The terminals, however, require far more width than the spacing of circuit traces on the printed circuit board because of the practicable manufacturable size and strength of the terminals that is desired. The diameter of the sensor connector must therefore be large enough to accommodate the rows of terminals and the walls separating the terminals. It is desirable to make the sensor connector circular because the circular hole in the catalyzer structure that mates therewith, can be manufactured easily with great precision in order to provide the best sealing properties. This means that the terminals disposed in rows as found in the prior art, does not effectively use the volume of the connector, especially towards the periphery, therefore requiring a large diameter connector.

SUMMARY OF THE INVENTION

With reference to the above mentioned problems, the object of this invention is therefore to provide a compact circular connector for electrical connection to an internal printed circuit board.

A further object of this invention is to ensure good electrical contact between the circuit board and the conducting wires.

Yet another object of this invention is to provide a cost effective connector.

Yet another object of this invention is to provide a high temperature sensor connector that can be assembled without risk of damaging the contacts during the assembly procedure.

The objects of this invention have been accomplished by providing a circular sensor connector comprising a plurality of terminals for electrical connection to an internal printed circuit board, characterized in that the terminals are disposed in a radial manner around the printed circuit board.

A further object of this invention has been accomplished by providing a connector with terminals that have arcuate contact profiles that tangentially contact the printed circuit board.

An object of this invention has been accomplished by providing a circular sensor connector comprising a plurality of identical terminals.

An object of this invention has been accomplished by providing a method of introducing a printed circuit board between contacts of a circular sensor connector with use of a special tool.

An object of this invention has been achieved by providing a connector having electrical terminals that are preformed such that the contacts are spaced apart to receive a circuit board without contact therewith, the terminals having lever arms engageable with camming surfaces during assembly of the connector such that the contacts are biased onto circuit traces of the circuit board.

BRIEF DESCRIPTION OF THE DRAWINGS

FIG. 16 is a view in the direction of the arrow A of the connector of FIG. 1;

DETAILED DESCRIPTION OF THE PREFERRED EMBODIMENT

Figure 1:
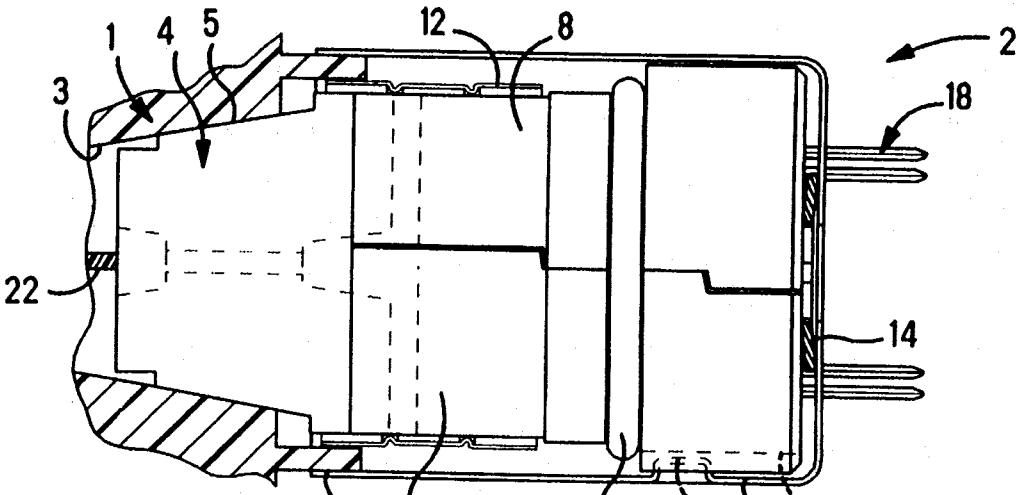
FIG. 1 is a side view of the preferred embodiment of part of the catalytic sensor connector shown embedded at a forward end in the housing of a catalyzer.

With respect to FIG. 1, a forward section of a catalyzer sensor connector is generally shown at 2, comprising a forward conical housing part 4, two half shells 6 and 8, a clamping ring 10, an outer shell 12, a cup spring 14, an outer casing 16 with a polarizing projection 17, and terminals 18.

The forward connector part 2 is shown embedded in the metallic housing (only partially shown) of a catalyzer 1, the catalyzer 1 having a conical cavity 3 that mates with the outer conical surface 5 of the forward conical part 4, whereby the conical surfaces 5 and 3 serve not only to securely position the connector 2 with respect to the catalyzer 1, but also to seal off the hot exhaust gases from leaking to the exterior of the catalyzer 1. To ensure that surfaces 3 and 5 are pressed together, the spring 14 pushes against the two half shells 6 and 8 which correspondingly push onto the forward housing part 4. The opposing reactional force of the spring 14 is taken up by the casing 16, made of metal and laser welded on it's forward portion 15 to the catalyzer body 1. The casing 16 encompasses the two half shells 6, 8 and is polarized with respect thereto by engagement of the projection 17 in a corresponding longitudinal groove 19 on the half shell 6 outer periphery.

The two half shells 6 and 8 and the forward conical part 4 not only need to be of dielectric material but must also withstand the high exhaust gas temperatures and are therefore made of ceramic material. Due to the difficulties of manufacturing and assembling the ceramic parts, the housing is separated into the forward conical part 4 and two halves 6 and 8, whereby a clamping ring 10 is provided to hold the two half shells 6 and 8 together.

Figure 3:
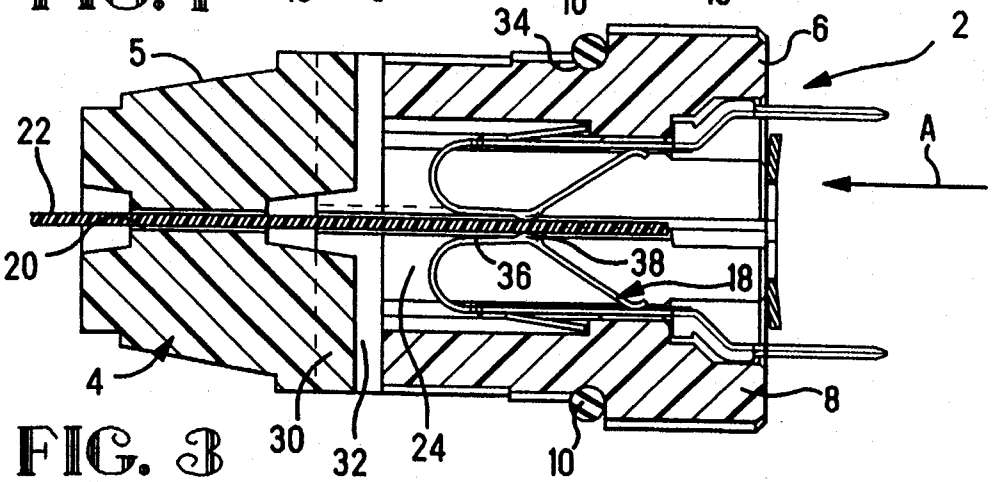
FIG. 3 is a cross sectional view through the line 3—3 of FIG. 2.
Figure 1A:
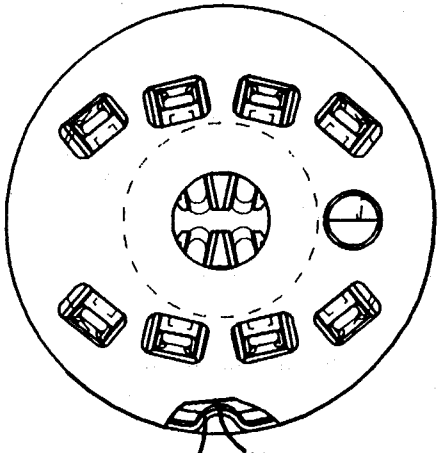
Figure 2:
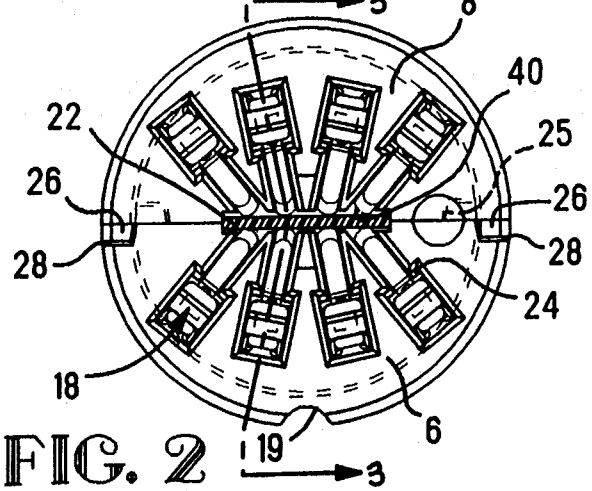
FIG. 2 is an end view of part of the catalytic sensor connector seen in the direction of arrow A of FIG. 3.

In FIG. 3, the connector 2 is shown having a slot 20 for reception of a ceramic printed circuit board 22 on which are deposited electrical circuit traces, electrical contact being made to the printed circuit board by terminals 18. The terminals 18 are retained within cavities 24 of the half shells 6 and 8 in a compact radial arrangement around the printed circuit board 22 as shown in FIG. 2. Also shown on FIG. 2 are projections 26 on the half shell 8 and corresponding cavities 28 on the half shell 6 that serve to correctly locate the half shell 8 to the half shell 6.

Figure 4:
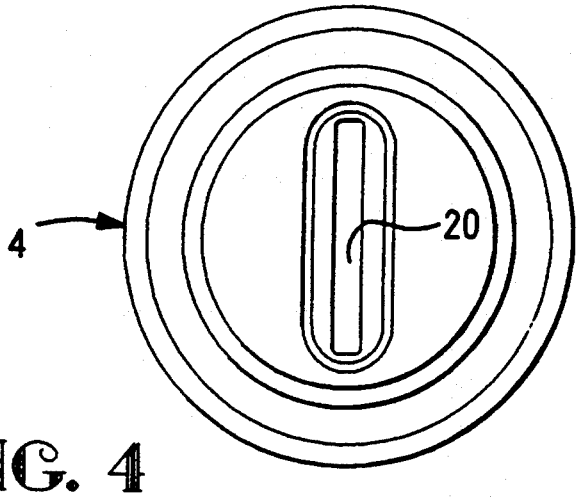
FIGS. 4, 5 and 6 are respectively top, longitudinal cross sectional and bottom views of the forward conical housing member.
Figure 5:
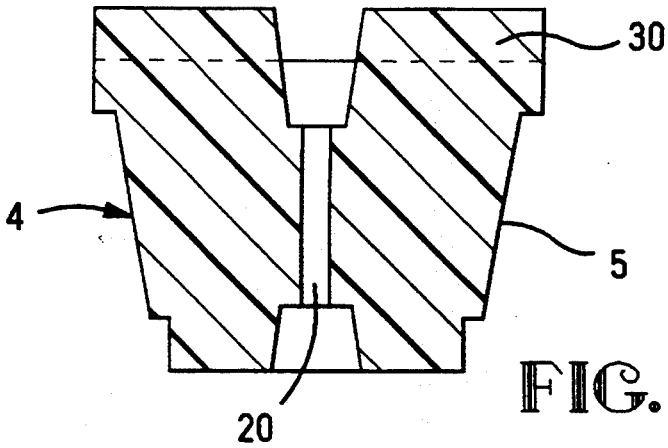
Figure 6:
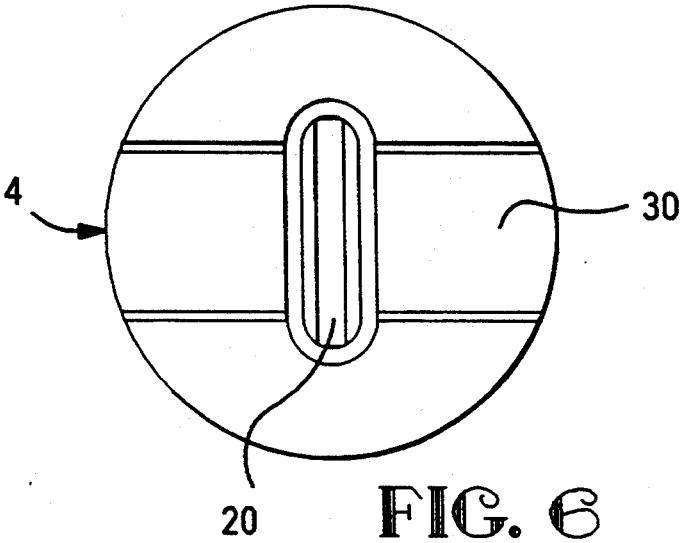

Referring to FIGS. 4, 5 and 6, the conical forward part 4 is shown in more detail with the printed circuit board receiving slot 20, the conical mounting surface 5 and at the rear end a projection 30 that engages with a recess 32 of the half shells 6 and 8, as shown in FIG. 3, whereby this engagement positions and prevents rotation of the half shells 6, 8 with relation to the forward part 4.

Figure 7:
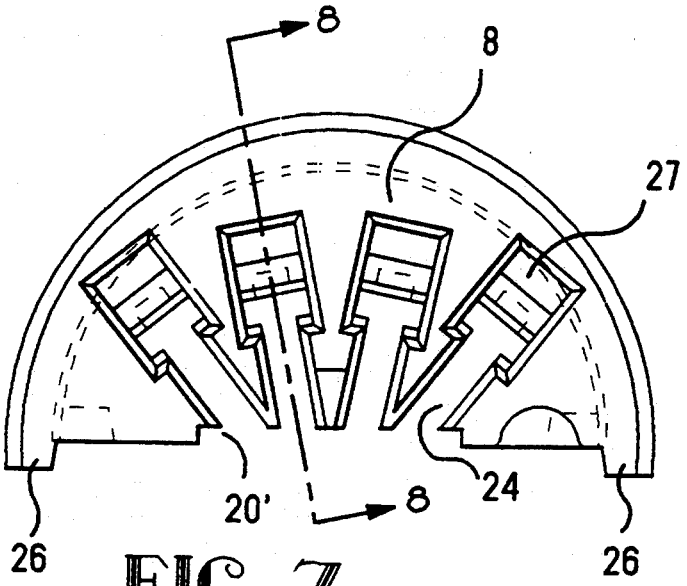
FIG. 7 is a rear end view of a housing half shell.
Figure 8:
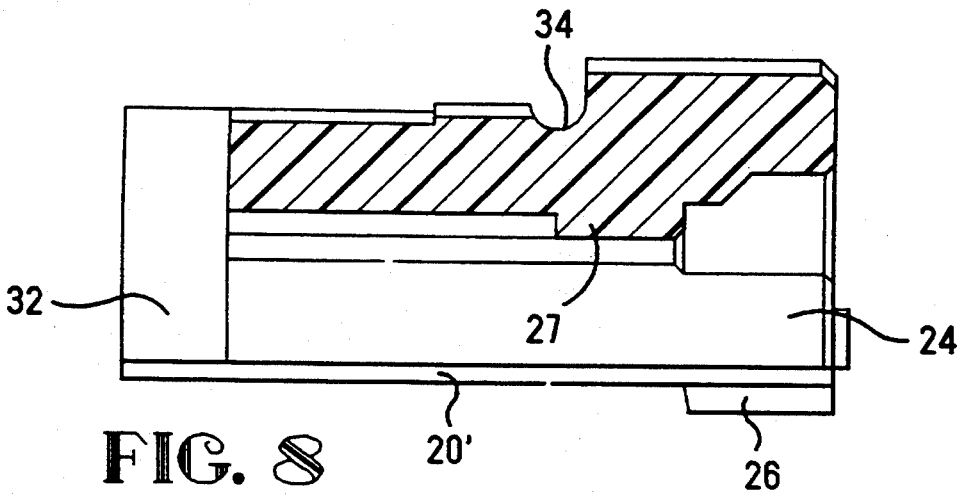
FIG. 8 is a cross sectional view through line 8—8 of FIG. 7.
Figure 9:
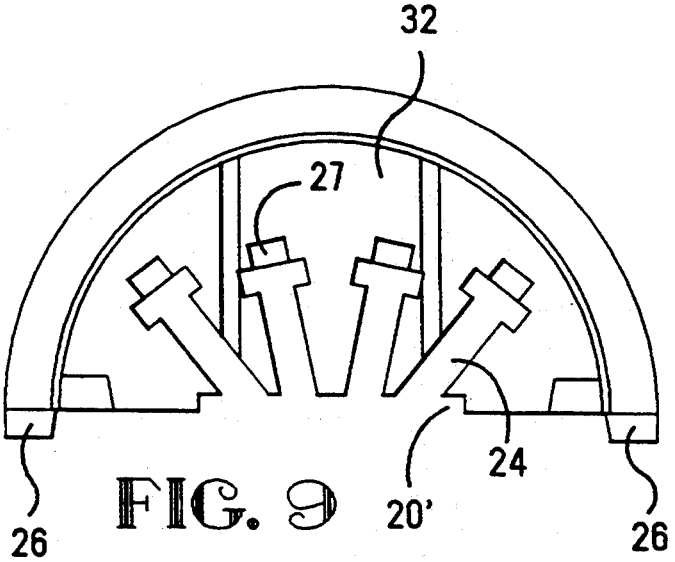
FIG. 9 is a front end view of the half shell of FIGS. 7 and 8.

The projection 26 (FIGS. 7, 8, 9) locates within a corresponding recess 28 on the half shell 6 for correct positioning of the shell 6 with respect to the shell 8, the shell halves being held together by the clamping ring 10 which is seated in an annular groove 34. Within the shell halves are cavities 24 disposed in a radial manner around the printed circuit board receiving slot 20; each cavity 24 having a shoulder 27 for the purpose of retaining the terminal 18 within the cavity 24.

Because the goal is to measure certain parameters of the exhaust gases, the sensor connector 2 should disturb as little as possible the structural integrity of the catalytic converter structure and also not cause any gas leakage, this essentially meaning that the connector 2 should be as small as possible, in particular the diameter of the conical opening 3. In order to have a small diameter connector, the width of the printed circuit board 22 must be correspondingly small. This however poses a problem of access to the circuit traces by the terminals 18 if they are to be aligned in a row. By disposing the terminals in a radial manner however, one can use the greater volume at the outer diameter of the connector but nevertheless making contact with the printed circuit board 22 by extending a contact arm 36. In order to accommodate the various angles at which the terminals 18 contact the printed circuit board 22 (FIG. 2), the contact arm 36 has a longitudinal arcuate contact projection 38 with a transverse arcuate contacting profile 40 that can maintain a tangential contact with the printed circuit board through different angles of the terminals 18 with respect thereto. In the preferred embodiment, the profile 40 is substantially circular.

Figure 11:
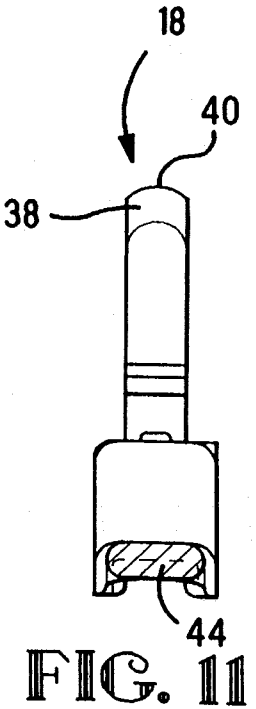
FIG. 11 is a cross sectional view through line 11—11 of FIG. 10.
Figure 10:
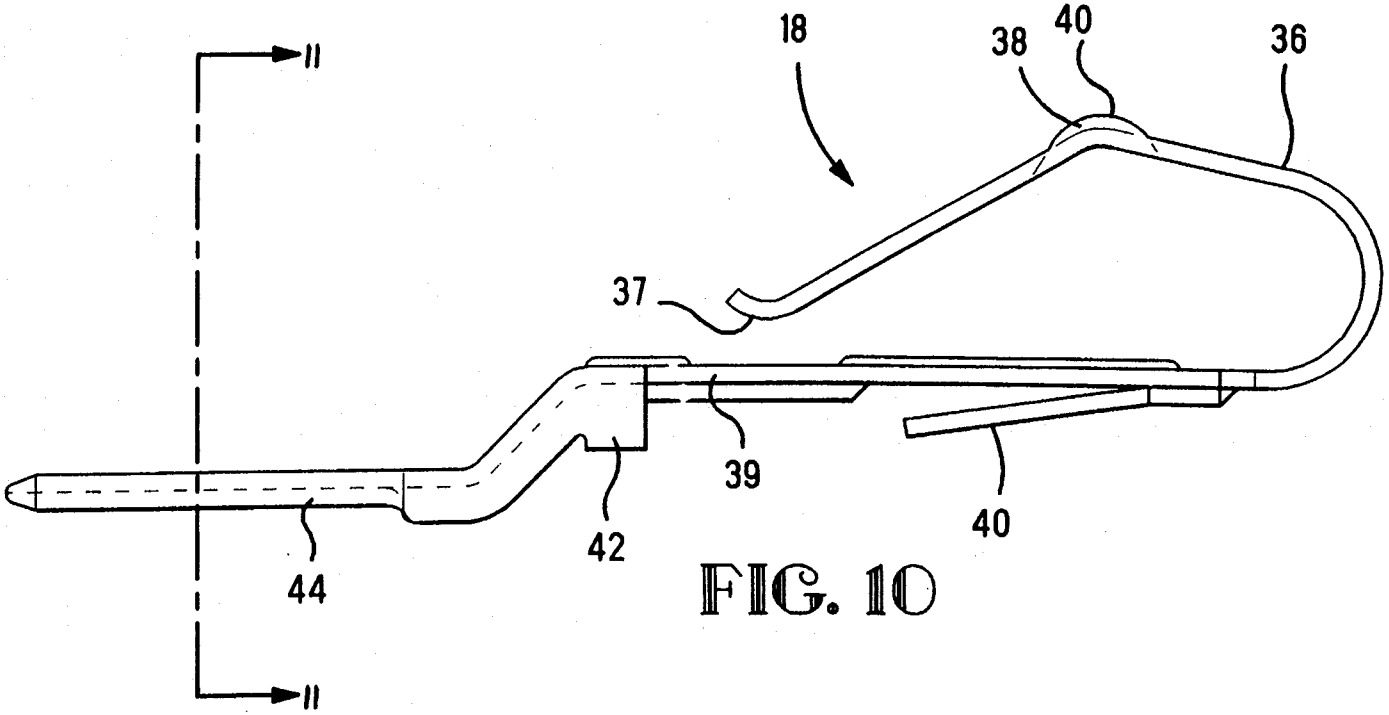
FIG. 10 is a detailed view of a terminal that is insertable into cavities of the half shells.

The terminal 18 is shown in greater detail in FIGS. 10 and 11. The terminal 18 is stamped and formed from sheet metal and comprises the U-shaped resilient contact arm 36, a locking lance 40, a retaining projection 42 and a tab terminal section 44. The contacting surface 40 makes electrical contact with the printed circuit board 22 by being resiliently biased thereagainst. The longitudinal contact projection 38 with its longitudinal outwardly projecting arcuate profile, ensures that contact with the printed circuit board is always made thereagainst at a tangent to the profile of contact projection 38 when manufacturing inaccuracies such as the printed circuit board thickness or position of the terminals 18 vary the position and angle of the contact arm 36, with respect to contact projection 38. Additionally, the contact arm 36 has a bent free end 37 that increases the resilient strength of the contact arm 36 during insertion of the printed circuit board into the slot 20, by pressing against the middle section 39 of the terminal 18.

The resilient locking lance 40 is resiliently biased under the shoulder 27 during insertion of the terminal 18 into the cavity 24 and then springs open once past the shoulder to abut thereagainst preventing rearward extraction of the terminal, and a forward retaining projection 42 on the terminal abuts against the opposing side of the shoulder 27 to prevent forward movement of the terminal 18.

Figure 12:
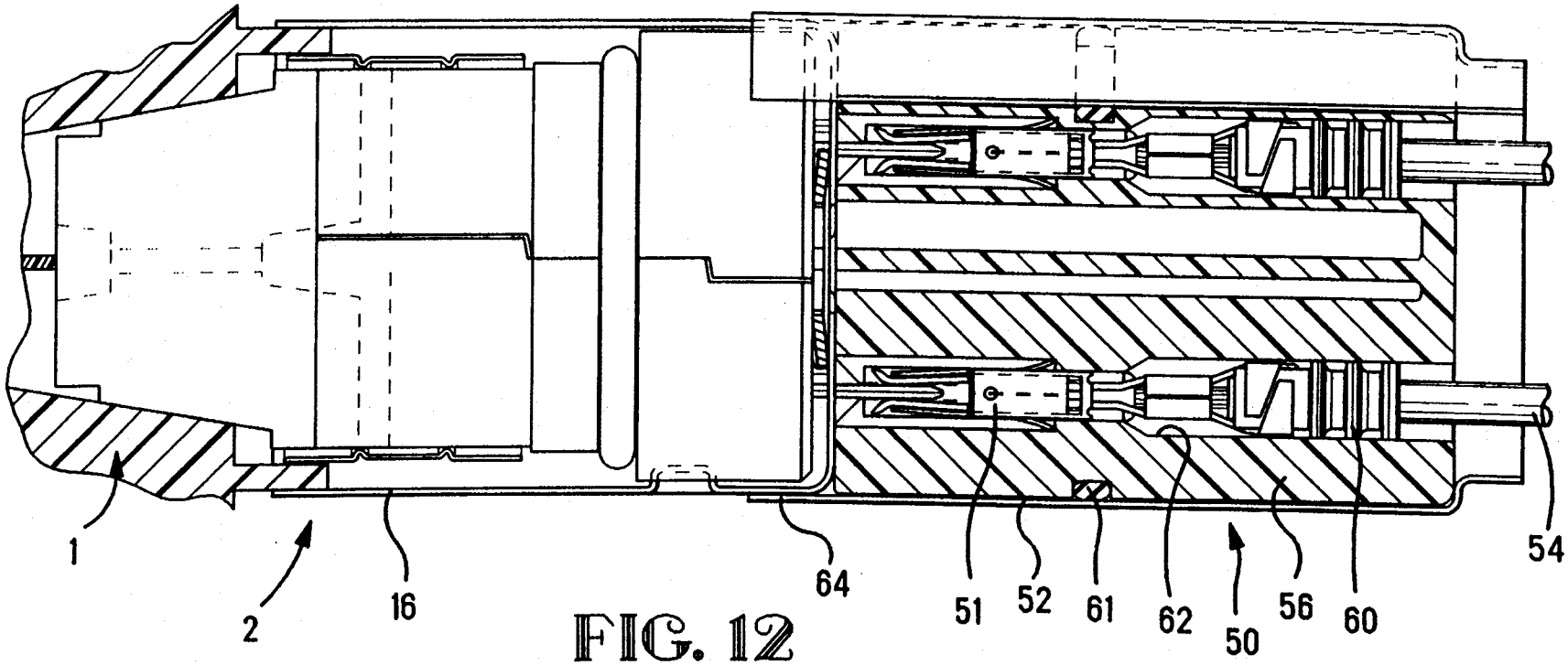
FIG. 12 is a partial cross sectional view of a fully assembled catalytic sensor connector.

At the rear end of the terminal 18 is a flat tab terminal 44 which is strengthened by folding the sheet metal into double thickness. The tab terminal 44 projects rearwards of the half shells 6 and 8 and serves to make electrical contact with receptacle terminals 51 assembled in a second housing 56, this housing also having an outer casing 52 that is attached to the casing 16 as shown in FIG. 12.

The second connector 50 allows the first connector 2 to be assembled separately to the catalytic converter 1 and in an ulterior step, connected to the second connecting 50 which makes electrical connection between the terminals 18 and electrical conducting wires 54. Because of the poor thermal conductivity of the ceramic material from which the forward conical part 4 and the shell halves 6 and 8 are formed, heat flow from the front to the rear of the first connector section 2 is very small and the second connector 50 can therefore be maintained cool enough to allow use of a plastic housing 56; a one piece plastic injection molding which is far cheaper to manufacture than the ceramic parts 4, 6 and 8.

Figure 15:
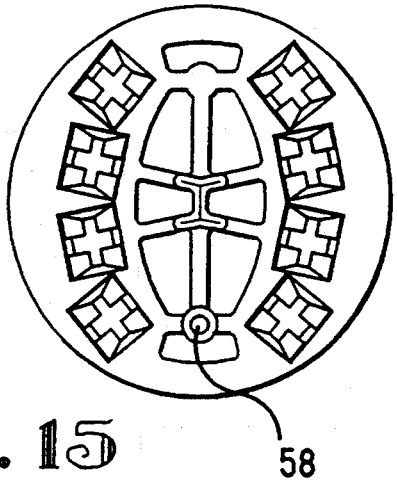
FIG. 15 is a front end view of the housing of FIGS. 13 and 14.
Figure 14:
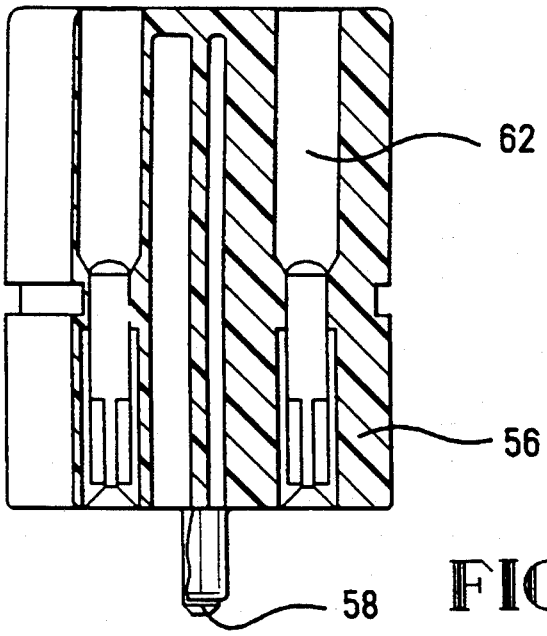
FIG. 14 is a cross sectional view through line 14–14 of FIG. 13.
Figure 13:
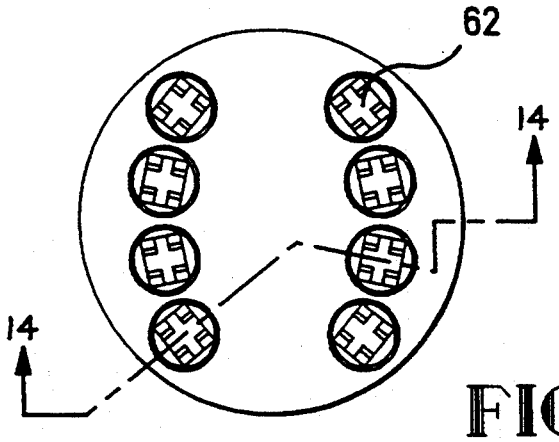
FIG. 13 is a rear end view of a receptacle terminal housing that corresponds to the rear part of the connector shown in FIG. 12.

Referring to FIG. 14, the dielectric housing 56 has a locating pin 58 that fits into the recess 25 (FIG. 2) of the half shells, the pin 58 and corresponding recess 25 serving to correctly polarize the second connector 50 with relation to the first connector 2. As seen in FIGS. 13 and 15 terminal receiving cavities 62 are disposed in alignment with the terminals 18. An outer "O"-ring seal 61 between the housing 56 and casing 52, as well as single wire seals 60 around the conducting wires 54 in the terminal receiving cavities 62, prevent dirt and liquid ingress into the contacting area of the terminals 51.

The casing 52, during final assembly, is welded by laser at a overlapping position 64 to the casing 16 of the first connector.

Figure 21:
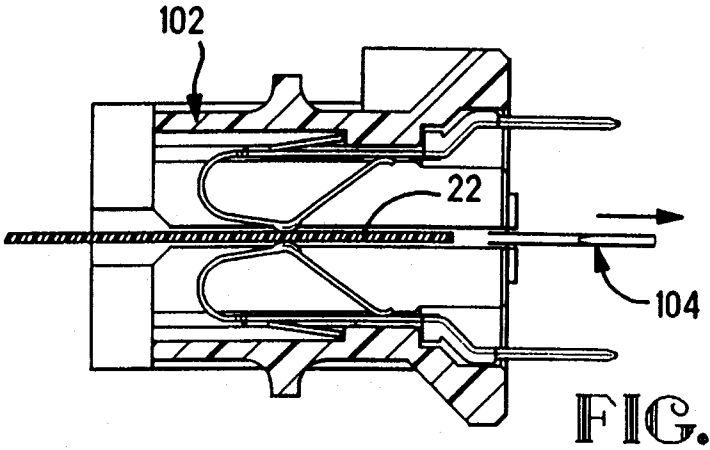
Figure 23:
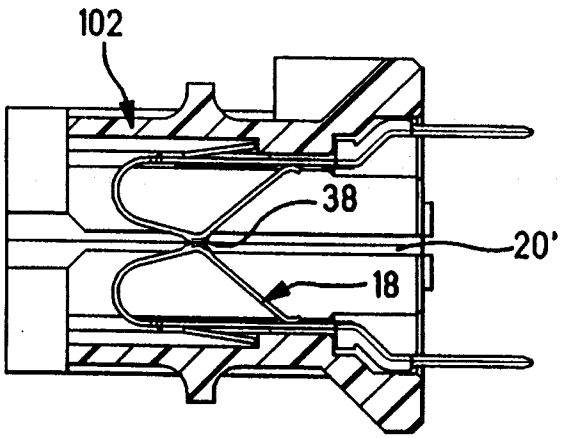
FIG. 23 is a cross sectional view through the body of the connector of FIG. 22 with terminals mounted therein.
Figure 22:
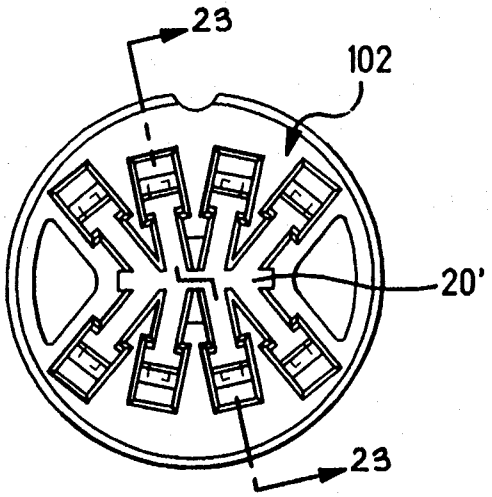
FIG. 22 is a rear view of the circular connecting housing of the embodiment of FIGS. 17 to 21.
Figure 24:
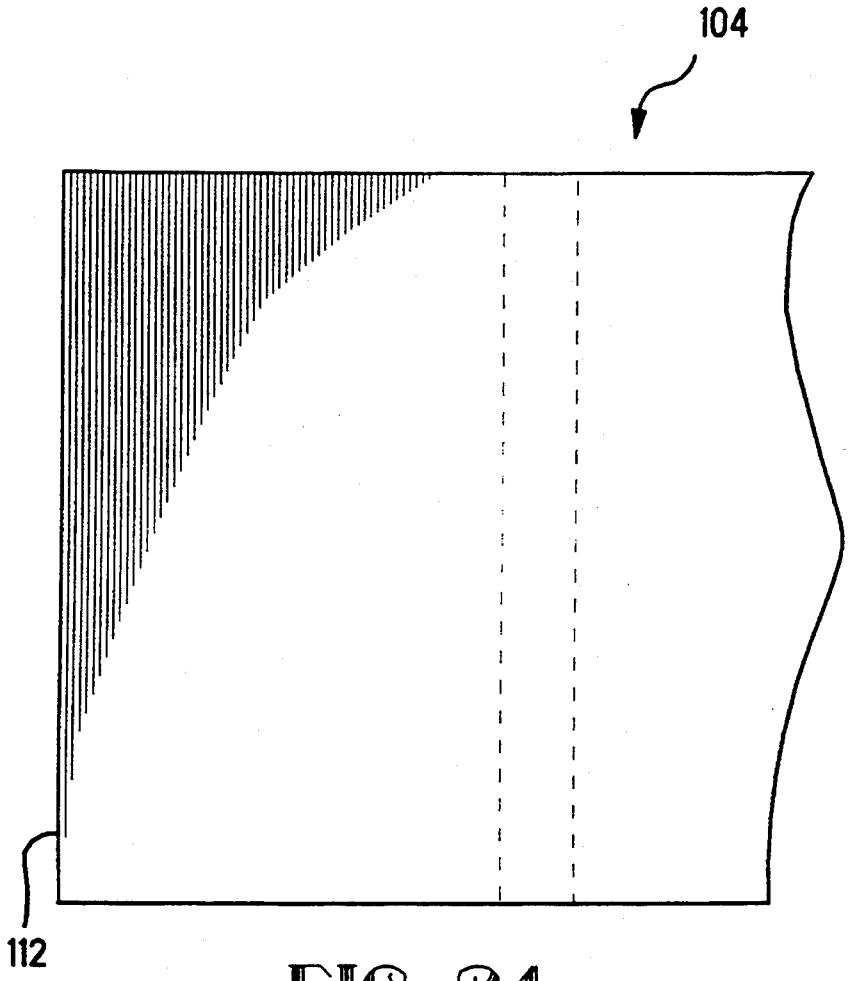
FIGS. 24 and 25 are respectively, partial plan and side views of the board insertion tool shown in FIGS. 17 to 21.
Figure 25:
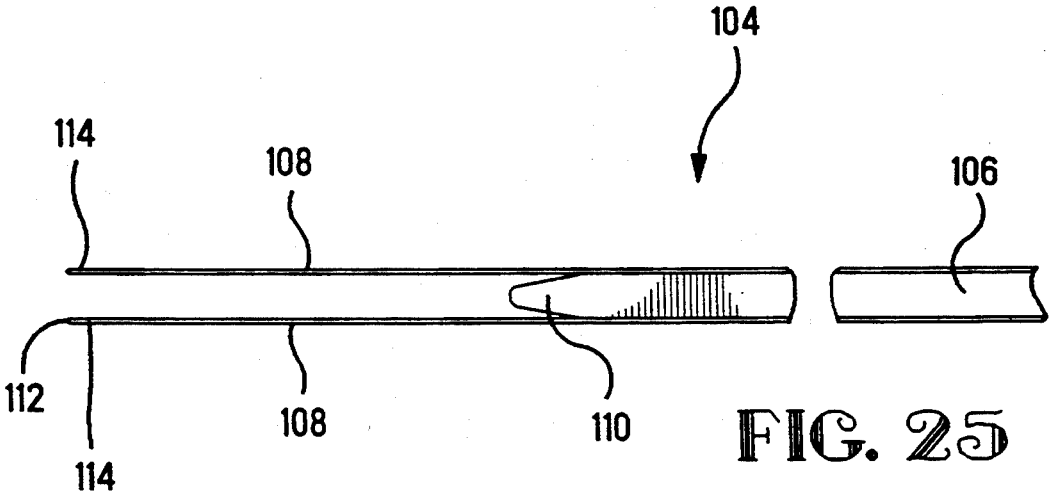

Referring to FIGS. 21 and 23, another embodiment of the invention is shown whereby the two half shells are replaced by a single ceramic part 102 within which the terminals 18 are locked in a similar manner to the embodiment of FIGS. 1 to 16. All other features of this embodiment are similar and denoted with the same numbering. The embodiment comprising the half shells 6 and 8, had the advantage of providing parts that can be manufactured easier than the single housing of the second embodiment 102, the half shells 6 and 8 also providing for assembly of the terminals directly onto the ceramic printed circuit board 22 without having to insert the board between the contacts 38 whereby the sharp broken edges of the ceramic could damage or remove the gold plating thereof. The disadvantage of the half shells 6 and 8 however, is that there are more parts to produce and assemble whereby great accuracy is needed in order to correctly mate the half shells 6 and 8. By producing a single ceramic body 102 one overcomes the latter problem but introduces a new problem, namely the risk of damaging the contact surfaces 38 by introduction of the ceramic printed circuit board therebetween. In order to overcome this, a special tool generally shown at 104 in FIGS. 24 and 25 comprises an inner plate member 106 of substantially the same thickness as the printed circuit board 22, and a pair of thin outer plate members 108 that could be made, for example, out of stainless steel. The inner plate member 106 has a tapered forward end 110. The outer plate members have smoothly rounded forward tips 112.

Figure 18:
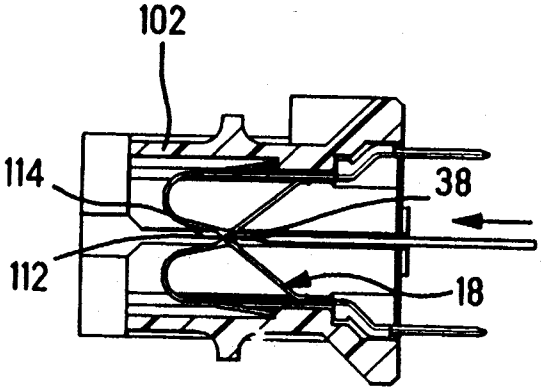
FIGS. 17 to 21 are cross sectional views of another embodiment of the invention illustrating a method of inserting a printed circuit board between the terminals thereof.
Figure 20:
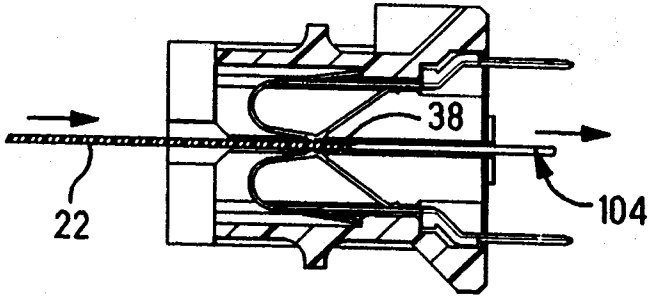
Figure 17:
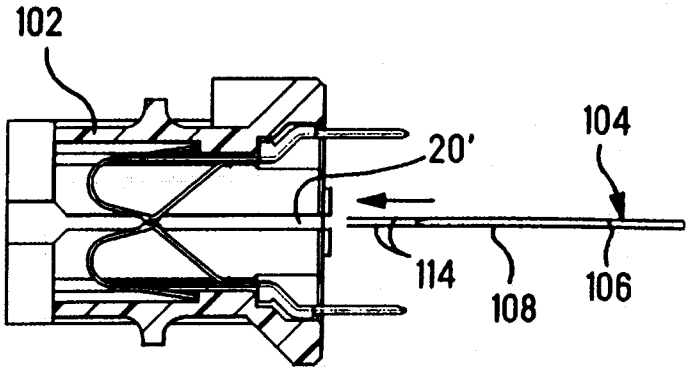
Figure 19:
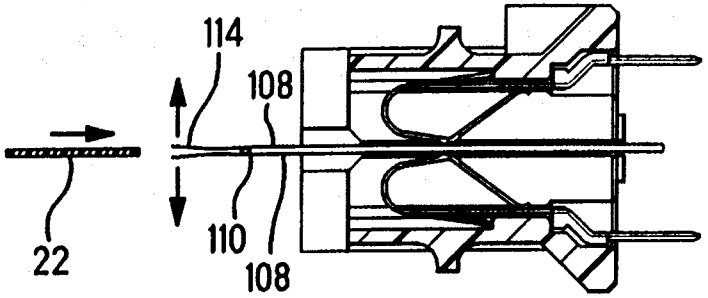

Referring now to FIGS. 17 to 21 the insertion of the printed circuit board 22 between the terminals 18 will now be explained. The tool 104 is first inserted into the rear of the ceramic shell 102 in the slot 20' provided for the printed circuit board 22 until the front cantilevered portions 114 of the thin outer plates 108 abut the contact portions 38 of the terminals 18. Due to the smoothly rounded tips 112 of the outer plates 108, on contact with the contact portions 38 the cantilevered front portions 114 are biased together and inserted between the contacts 38 as shown in FIG. 18. The tool is then further inserted until the front portions 114 project past the front end of the ceramic body 102 for reception of the printed circuit board 22 whereby the forward cantilevered portions 114 of the plates 108 are biased away from each other by magnetic means or elastic pre-stressing thereof, such that the printed circuit board can be inserted between the rounded tips 112 and urged towards the inner plate member 106 until it abuts the forward portion 110. The printed circuit board 22 and the tool 104 can then be retracted through the body 102 until the printed circuit board is correctly positioned therein and the tool can be removed as shown in FIG. 21. Due to the thin cantilevered plate portions 114 that overlap the front edge of the printed circuit board 22 during insertion thereof between the terminals 18, the gold plated contacts 38 are protected from damage therefrom.

Referring to FIGS. 26 to 29, another embodiment of this invention is shown, this embodiment designed to be assembled without requiring a special tool to protect the terminal contacts. Features of this embodiment that are similar in function to embodiments shown in FIGS. 1 to 23, are denoted with a prime number. A catalytic converter sensor connector 2' for making electrical connection to a ceramic printed circuit board 22', comprises a forward ceramic housing 4' mountable to a structure, and a terminal receiving housing 102' formed of a single ceramic body. Mounted within the housing 102', are terminals 18' produced from circular wire. Within the housing 102', is a cavity 24' through which the terminals 18' extend, the cavity 24' also for receiving the printed circuit board 22' therein. The terminals 18' are disposed in a radial manner about the printed circuit board 22' for the same reasons as described in the above embodiments. The terminal 18' comprises an outer pin terminal section 44' for electrically contacting a complementary conductor, a midsection 115 set within cavities of the housing 102' such that the terminals 18' cannot rotate, a printed circuit board contact section 116 having contacts 38', and a contact actuation lever arm 118 having curved-in ends 120. The forward ceramic housing 4' to which the printed circuit board 22' is bonded by bonding material 122, comprises a cavity 124 surrounding a certain length of the printed circuit board 22' and having a tapered lead-in camming portion 126 for engagement with the lever arms 118 of the terminals 18'.

Figure 27:
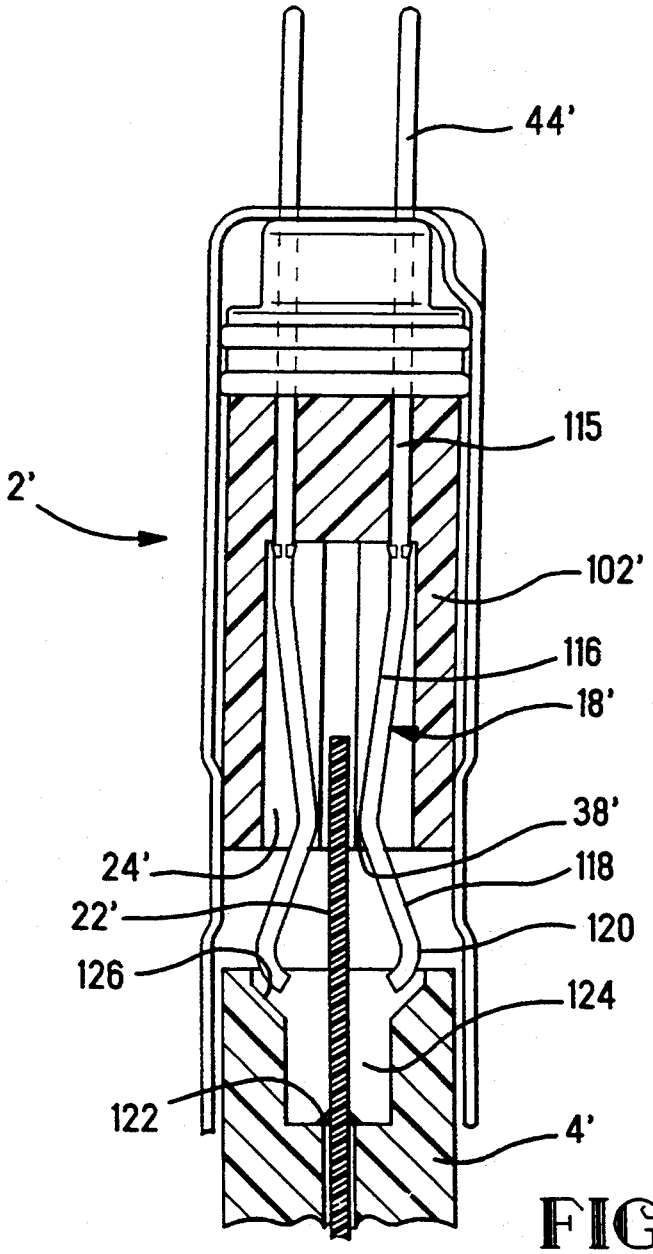
FIGS. 27 to 29 are longitudinal cross-sectional views of the embodiment of FIG. 26, showing assembly of first and second connector parts.
Figure 26:
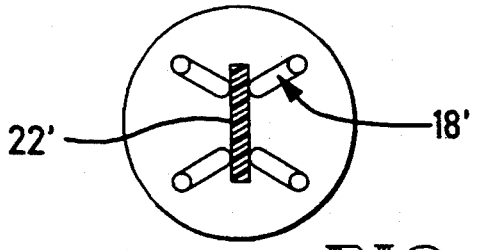
FIG. 26 is an end view of another embodiment of this invention illustrating terminals contacting the printed circuit board.
Figure 28:
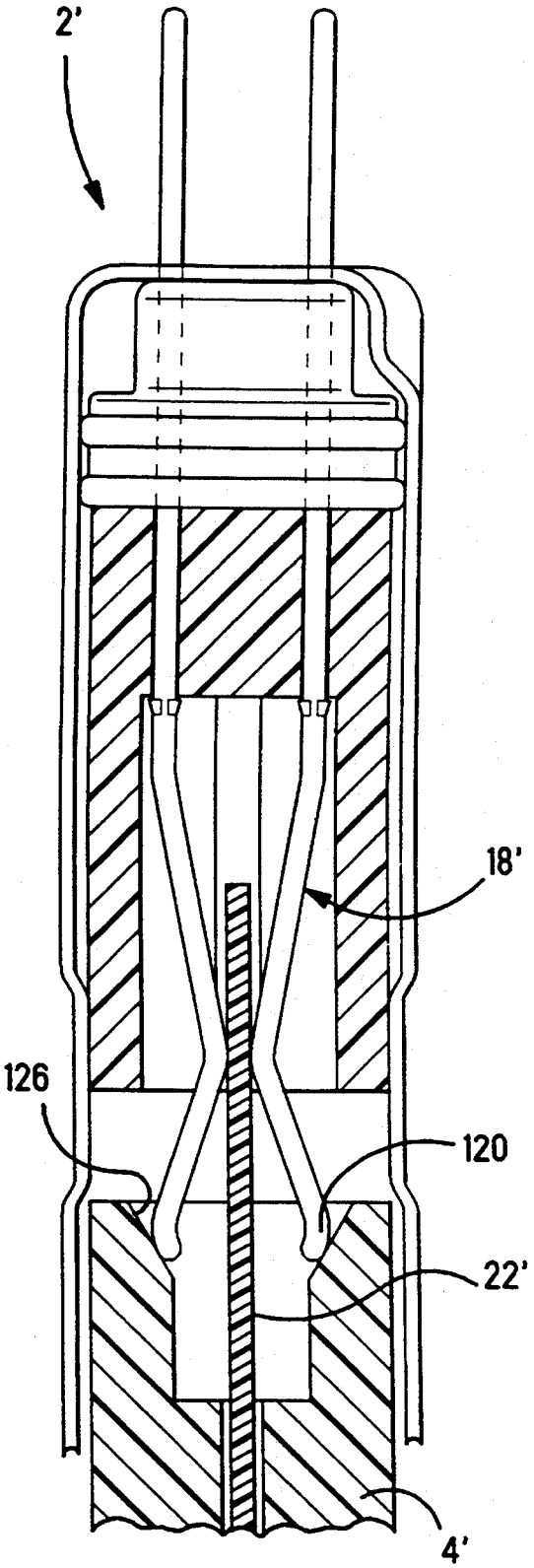
Figure 29:
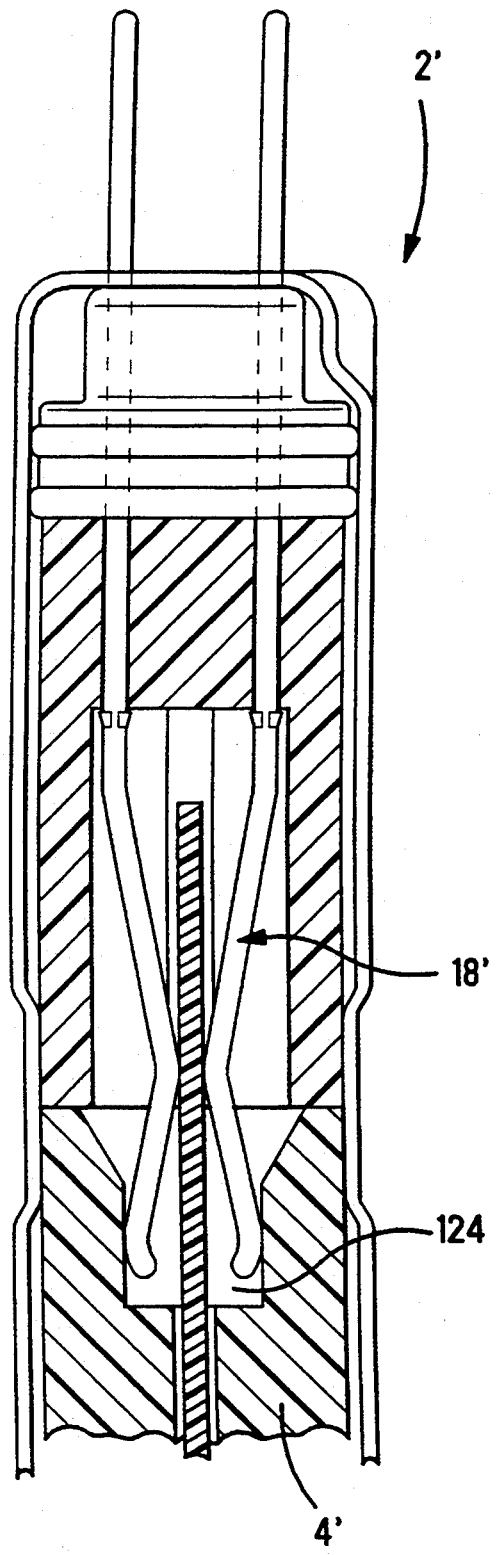

With reference to FIGS. 27 to 29, assembly of the forward ceramic housing 4' and printed circuit board 22' to the terminal housing 102' will now be described. The terminals 18' are preformed as shown in FIG. 27, such that the spacing between the contacts 38' is greater than the thickness of the printed circuit board 22'. This ensures that the printed circuit board 22' can be inserted between the contacts 38' without contact therewith, thereby avoiding damage of the gold plated contact surface by the sharp, hard corners of the ceramic board 22'. By then further inserting the printed circuit board 22', the curved ends 120 of the terminals 18 enter into the mouth of the cavity 124 until they abut the tapered lead-in camming portion 126 of the forward ceramic housing 4'. Further urging of the forward housing 4' toward the terminal housing 10240 , causes the tapered lead-in camming portion 126 to resiliently cam in the terminal lever arms 118', as shown in FIG. 28, until the terminal contacts 38' enter into electrical contact with the printed circuit board 22'. Insertion is continued until the forward housing 4' abuts the terminal receiving housing 102' as shown in FIG. 29, the lever arm curved ends 120 are enclosed within the cavity 124 and ensuring that the terminal contacts 38' are resiliently biased with sufficient contact force against circuit traces on the printed circuit board 22' for good electrical contact therewith. The use of circular wire to produce the terminals 18' eliminates the need to form particular arcuate contact surfaces, is simple and cost effective to manufacture, and allows for a compact configuration due to the slenderness thereof.

Advantageously therefore, due to the radial disposition of the terminals 18, 18' a compact configuration of a circular sensor connector is achieved. Yet another advantage is the assembly of a high temperature printed circuit board between the terminals of the connector without risk of damage thereto by either providing a special insertion tool or by providing terminals that are cammed into electrical contact with the printed circuit board during assembly thereof.

We claim:

1. A circular sensor connector comprising a first housing member and cavities, having a plurality of terminals mounted therein for electrical connection to an internal substantially planar printed circuit board extending in a longitudinal direction, the terminals also extending in a longitudinal direction, characterized in that the terminals are disposed in a radial manner around the printed circuit board such that they are oriented at different angles with respect to each other about the longitudinal direction.

2. The connector of claim 1 characterized in that the terminals of the first housing member have an arcuate contact profile that tangentially contacts the printed circuit board.

3. The connector of claim 2 characterized in that the arcuate contact profile is substantially circular around the longitudinal direction.

4. The connector of claim 2 characterized in that the arcuate contact profile is transverse to a longitudinal arcuate contact projection that accommodates various inaccuracies in the position and angle of the projection with respect to the printed circuit board.

5. The connector of claim 1 characterized in that the terminals are insertable into the cavities of a forward connector part whereby tab sections of the terminals project rearwardly of the forward connector part and are connectable with terminals of a second connector section.

6. The connector of claim 1 characterized in that each terminal is stamped and formed from sheet metal and comprises a resilient contacting arm having a contact projection, a middle section, retention means and a tab terminal section, whereby the contact arm is forwardly bent in a U-shaped form from the top of the middle section to a free end that is cooperable with the middle section to increase resilient strength of the contact arm, and the tab terminal section projects from the bottom of the middle section, the tab terminal section being folded into double thickness of the sheet metal.

7. The connector of claim 1 characterized in that the plurality of terminals are all identical.

8. The connector of claim 1 characterized in that the connector comprises a second housing member having terminals therein, wherein the terminals of the second housing member are disposed in a radial manner about the longitudinal direction for alignment to the terminals of the first housing member.

9. The connector of claim 1 characterized in that the terminals are preformed such that contacts thereof are spaced away from either side of the printed circuit board during initial insertion thereof therebetween, the terminals comprising forward lever arms and camming portions engageable with a tapered camming surface of a matable connector during assembly of the connectors such that the terminal contacts are biased into contact with circuit traces on the printed circuit board.

10. The connector of claim 9 characterized in that the connector comprises a terminal receiving housing to which the terminals are mounted, and said matable connector to which the PCB is securely fixed, the matable connector comprising a cavity surrounding the PCB and facing the terminal receiving housing, the cavity comprising the camming surface proximate a terminal receiving end thereof, whereby the terminal camming portions are received within the cavity once the connector is assembled.

11. A method of assembling an internal printed circuit board to a circular sensor connector characterized by the steps of:

providing a connector body comprising a slot therein for receiving a printed circuit board and terminals mounted therein and comprising contact portions for making electrical contact to electrical traces on the printed circuit board; and providing a board insertion tool, the tool comprising external plate members to overlap a front edge of the printed circuit board such that the contact portions are protected from damage by the printed circuit board; inserting the tool from a rear end of the connector body into the slot until a front end thereof projects past a front end of the slot; biasing apart the external plate members; urging the printed circuit board against the tool front end whilst inserting the printed circuit board into the slot and between the contact portions.

12. The method of claim 11 characterized in that the tool comprises an inner plate member and external plate members adjacent opposing sides thereof, the external plate members comprising a front cantilevered portion projecting past a forward end of the inner plate.

13. The method of claim 12 characterized in that the inner plate member is of substantially the same thickness as the printed circuit board, and the external plate members are thin and flexible.

14. A sensor connector comprising a plurality of terminals for electrical connection to both sides of an internal printed circuit board, characterized in that the terminals are preformed such that contacts thereof are spaced away from either side of the printed circuit board during initial insertion thereof therebetween, the terminals comprising forward lever arms and camming portions engageable with a tapered camming surface during assembly of the connector such that the terminal contacts are biased into the contact with circuit traces on the printed circuit board.

15. The connector of claim 14 characterized in that the connector comprises a terminal receiving housing to which the terminals are mounted, and a forward part to which the PCB is securely fixed, the forward part comprising a cavity surrounding the PCB and facing the terminal receiving housing, the cavity comprising the camming surface proximate a terminal receiving end thereof, whereby the terminal camming portions are received within the cavity once the connector is assembled.

16. The connector of claim 14 characterized in that the terminals extend in a longitudinal direction and are disposed in a radial manner around the printed circuit board which extends longitudinally, such that they are oriented at different angles with respect to each other about the longitudinal direction.

17. The connector of claim 16 characterized in that the terminals are disposed symmetrically on either side of the printed circuit board.

18. The connector of claim 16 characterized in that the terminals have arcuate contact profiles transverse to the longitudinal direction for enabling tangential contact thereof against the printed circuit board at any of the radial orientations.

19. The connector of claim 16 characterized in that the terminals are made of substantially circular wire.

20. The connector of claim 15 characterized in that the terminal receiving housing is made of a single ceramic part.

21. The connector of claim 15 characterized in that the terminals comprise pin terminal sections extending in a substantially opposite direction to the camming portions for electrical connection to a complementary connector.

* * * * *